US007906917B2

(12) United States Patent
Tripathi et al.

(10) Patent No.: US 7,906,917 B2
(45) Date of Patent: Mar. 15, 2011

(54) STARTUP FLICKER SUPPRESSION IN A DIMMABLE LED POWER SUPPLY

(75) Inventors: Ajay Tripathi, Schaumburg, IL (US); Anand Upadhyay, Lake Forest, IL (US); Ningliang Mi, Mount Prospect, IL (US); Rama Venkat, Aurora, IL (US); Srinivasa M. Baddela, Mount Prospect, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 991 days.

(21) Appl. No.: 11/577,995

(22) PCT Filed: Oct. 26, 2005

(86) PCT No.: PCT/IB2005/053500

§ 371 (c)(1),
(2), (4) Date: Apr. 26, 2007

(87) PCT Pub. No.: WO2006/046207

PCT Pub. Date: May 4, 2006

(65) Prior Publication Data

US 2008/0136350 A1 Jun. 12, 2008

Related U.S. Application Data

(60) Provisional application No. 60/622,553, filed on Oct. 27, 2004.

(51) Int. Cl.
*G05F 1/00* (2006.01)
*H05B 41/36* (2006.01)

(52) U.S. Cl. ..... 315/291; 315/294

(58) Field of Classification Search ..... 315/291, 315/307, 224, 244, 312
See application file for complete search history.

(56) References Cited

U.S. PATENT DOCUMENTS

| | | | | |
|---|---|---|---|---|
| 6,488,390 | B1 * | 12/2002 | Lebens et al. | 362/231 |
| 6,498,440 | B2 * | 12/2002 | Stam et al. | 315/291 |
| 6,556,067 | B2 * | 4/2003 | Henry | 327/536 |
| 6,636,104 | B2 * | 10/2003 | Henry | 327/536 |
| 6,803,732 | B2 * | 10/2004 | Kraus et al. | 315/307 |
| 6,808,287 | B2 * | 10/2004 | Lebens et al. | 362/184 |

FOREIGN PATENT DOCUMENTS

JP 10-186912 * 12/1996

* cited by examiner

*Primary Examiner* — Douglas W Owens
*Assistant Examiner* — Minh D A

(57) ABSTRACT

A method and system of flicker suppression for an LED 26. The method includes providing a power supply 10 for supplying current to the LED 26. The power supply 10 includes a flicker suppressor 50 and is responsive to a dim command signal. The method further includes receiving the dim command signal at the power supply 10, switching the current on and limiting the current to maintain LED light output below 110 percent of the LED light output corresponding to the dim command signal.

22 Claims, 7 Drawing Sheets

STARTUP FLICKER SUPPRESSION IN A DIMMABLE LED POWER SUPPLY

CROSS REFERENCE TO RELATED APPLICATION

This application claims the benefit of U.S. provisional application Ser. No. 60/622,553, filed Oct. 27, 2004, which the entire subject matter is incorporated herein by reference.

The present invention relates to power supplies for light emitting diodes (LEDs). More specifically, the present invention relates to dimmable power supplies for light emitting diodes (LEDs) including circuitry to prevent flickering of the light output from the light emitting diodes (LEDs) for low output light levels.

LEDs are used as light sources for various applications including lighting in theatres, signal lighting in mobile vehicles such as cars, boats and planes, signage and ambient lighting in homes and offices, and mood lighting in retail shops. Some of these applications require the output light from the LEDs to be adjustable from 1% to 100% of the maximum light output. In some application, such as mood lighting, theatrical lighting or tail lights of a car, the LEDs are turned on at a low light output level.

LED power supplies capable of producing pulse width modulated current pulses are required to provide this range of light output. Pulse width modulated power supplies achieve dimming by providing a pulse width modulated signal to a switch in series or parallel with the LED load. Duty cycle control of the pulse width modulated pulses produces an adjustable average LED current and a respective current control to the LED. The peak current or nominal LED current is maintained at a constant value. A fly back converter controlled by the IC, such as an L6561 by ST Micro-electronics, constitutes the main power circuit. A pulse width modulation generation circuit provides the desired duty cycle control of the LED current. The LED power supply must build the LED current quickly, for example in less than 10 msec from startup, since the LED response time is on the order of nanoseconds. The pulses generated by the pulse width modulator lag the output voltage build-up with a resultant voltage build-up to the maximum value before the current feedback is detected. A current overshoot occurs for the first pulses due to the voltage build up. The peak detect delay in the feedback can also lead to an excessive voltage buildup.

When maximum light output is requested at startup, the resultant current overshoot is not significant since the output voltage is close to the steady state value. When startup occurs at low light output the overshoot is high, since the steady state voltage is lower than the startup output voltage. This LED current overshoot is significant at lower light levels, such as 1% to 25% of the maximum light output, and flickering is observed.

It is desirable to have a power supply, which suppresses the observed flicker when a LED is turned on. In particular, it is desirable to suppress the observed flicker when a LED is turned on to emit a light level under 10% of the maximum light output.

One form of the present invention is a method of flicker suppression for an LED. The method includes providing a power supply for supplying current to the LED. The power supply includes a flicker suppressor and the power supply is responsive to a dim command signal. The method further includes receiving the dim command signal at the power supply, switching the current on and limiting the current to maintain LED light output below 110 percent of the LED light output corresponding to the dim command signal.

A second form of the present invention is a system of flicker suppression for an LED including a power supply for supplying current to the LED. The power supply includes a flicker suppressor, and is responsive to a dim command signal. The power supply includes means for receiving the dim command signal at the power supply, means for switching the current on and means for limiting the current to maintain LED light output below 110 percent of the LED light output corresponding to the dim command signal.

A third form of the present invention includes a power supply for an LED, including a power supply circuit having an output for supplying current to the LED and a flicker suppressor operably connected to the output. The power supply circuit is responsive to a dim command signal.

The foregoing form as well as other forms, features and advantages of the present invention will become further apparent from the following detailed description of the presently preferred embodiments, read in conjunction with the accompanying drawings. The detailed description and drawings are merely illustrative of the present invention rather than limiting, the scope of the present invention being defined by the appended claims and equivalents thereof.

Figure 6:
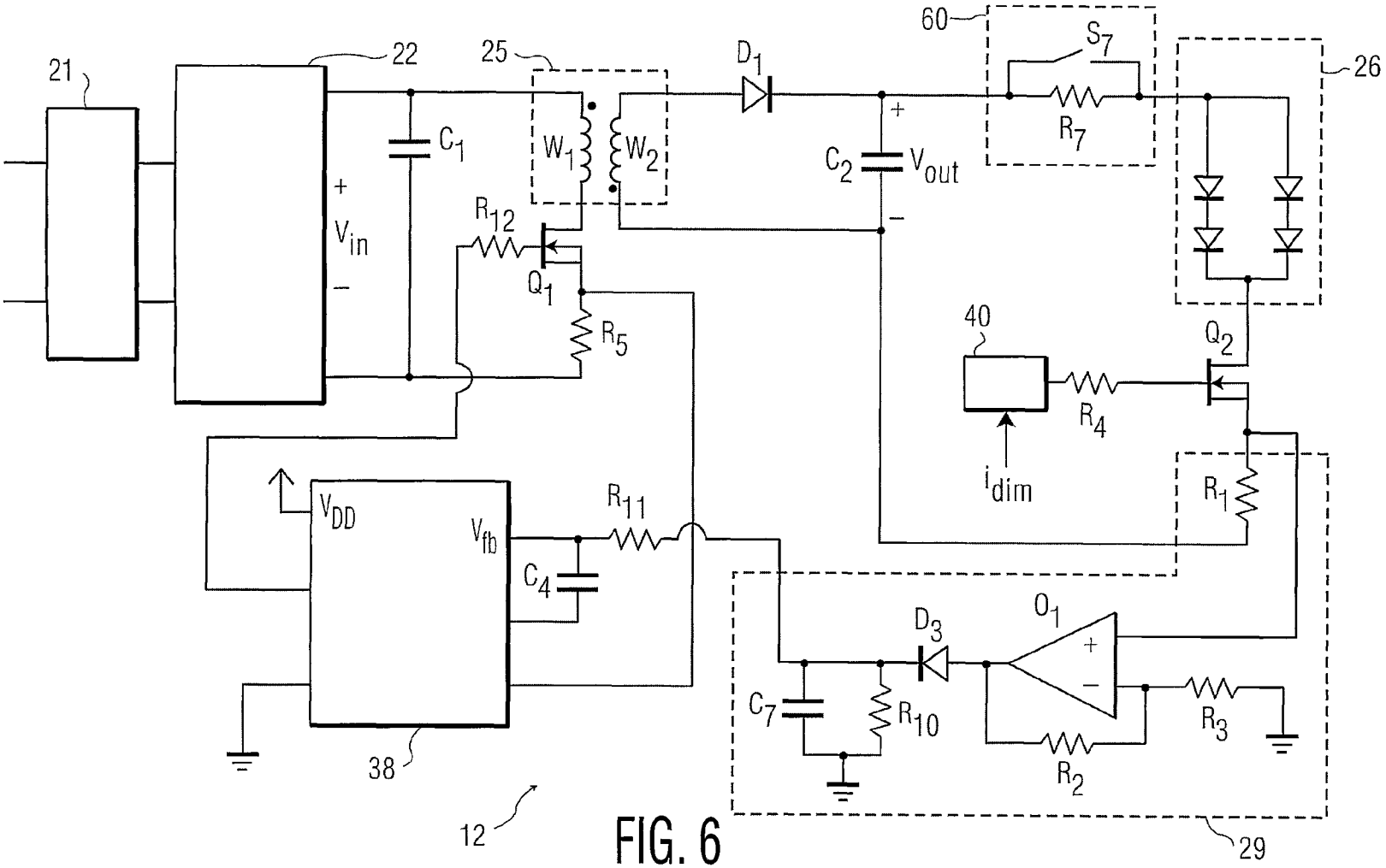
FIG. 6 shows a schematic diagram of a third embodiment of a power supply for an LED in accordance with the present invention.
Figure 7:
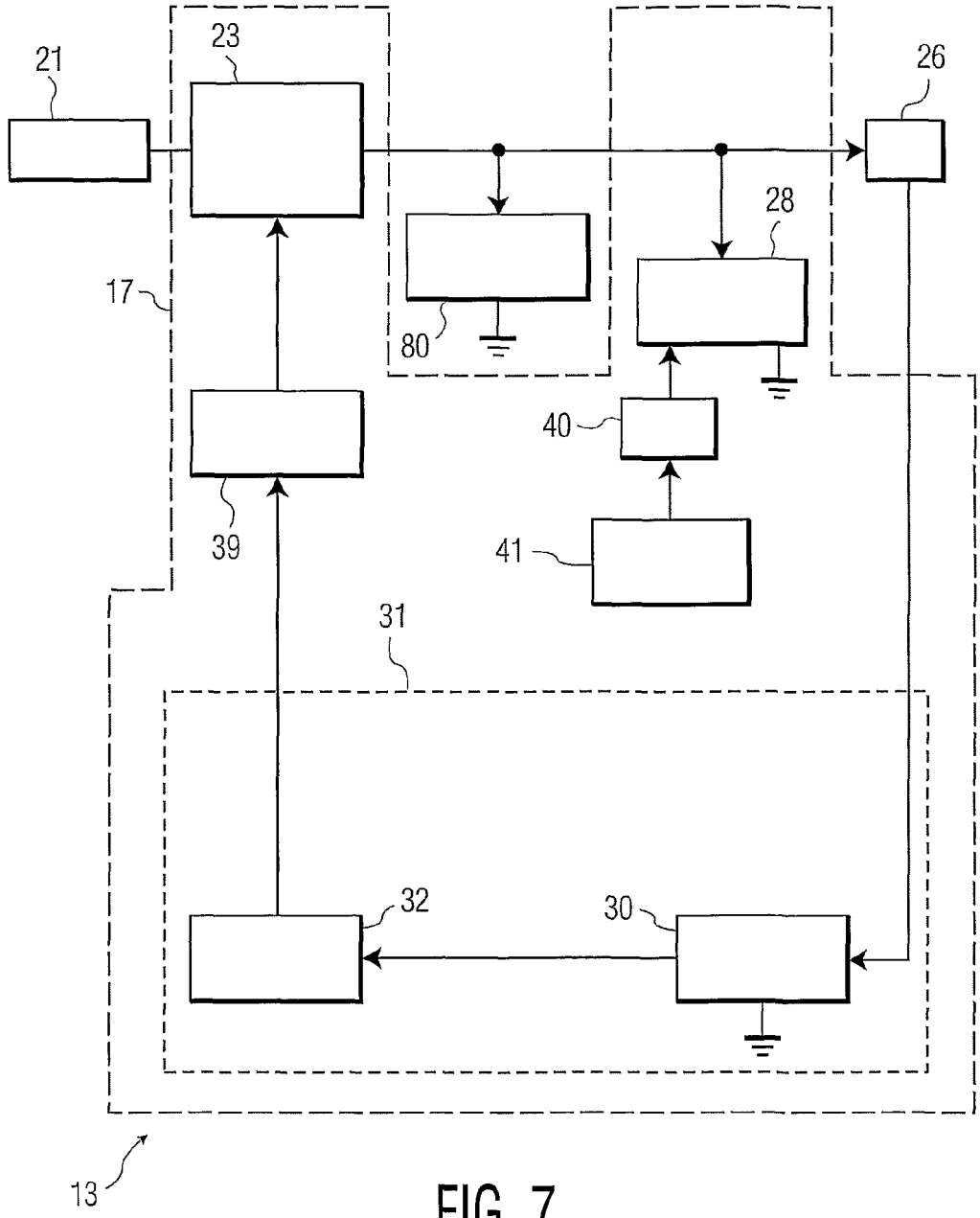

FIG. 7 shows a block diagram of a fourth embodiment of a power supply for an LED in accordance with the present invention; and In the power supplies 10-13 described in reference to FIGS. 1-7 flicker suppression is achieved at startup by limiting the current to the LED 26 to maintain LED light below 110 percent of the LED light output corresponding to a dim command signal input to the pulse width modulator 40. In some embodiments, the current to the LED 26 is limited during power-up of the LED 26.

In one embodiment, the power supplies 10-13 achieve flicker suppression by limiting the current to the LED 26 to maintain LED light output during power-up below 110 percent of the LED light output corresponding to the dim command signal, so that LED light output is below 110 percent of the LED light output corresponding to a dim command signal input to the pulse width modulator 40 to minimize the overshoot and the undershoot.

In another embodiment, the power supplies 10-13 achieve flicker suppression by limiting the current to the LED 26 during power-up to maintain LED light output less than or equal to the LED light output corresponding to the dim command signal, so that LED light output is less than or equal to the LED light output corresponding to a dim command signal input to the pulse width modulator 40 to minimize the overshoot and the undershoot.

In yet another embodiment, the power supply 10-13 achieve flicker suppression by limiting the current to the LED 26 during power-up to maintain LED light output to between 105 and 95 percent of the LED light output corresponding to the dim command signal, so that LED light output is between 105 and 95 percent of the LED light output corresponding to a dim command signal input to the pulse width modulator 40 to minimize the overshoot and the undershoot.

Figure 1:
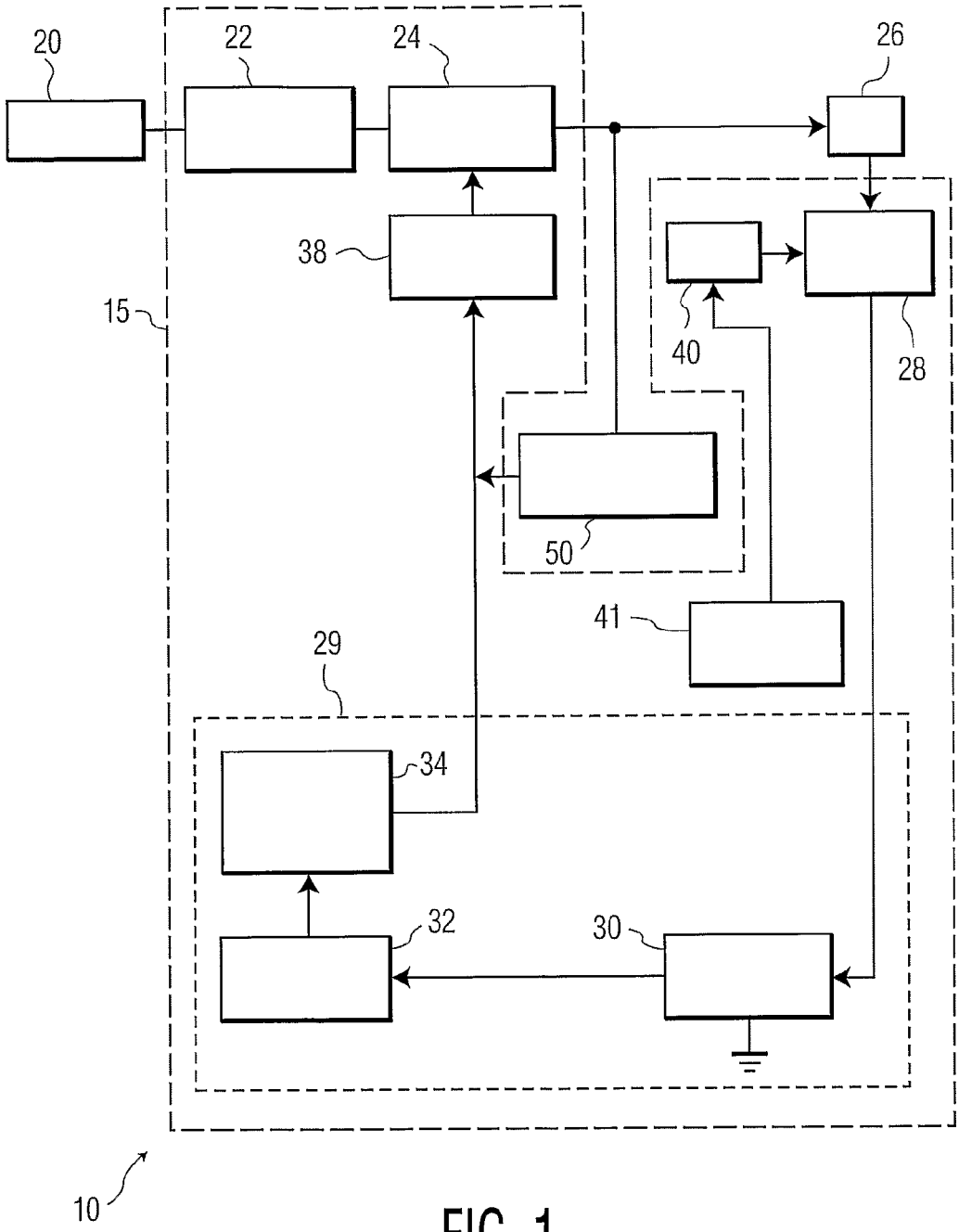
FIG. 1 shows a block diagram of a first embodiment of a power supply for an LED in accordance with the present invention.

FIG. 1 shows a block diagram of a first embodiment of a power supply 10 for an LED 26 in accordance with the present invention. The power supply 10 provides power to an LED 26 and includes a power supply circuit 15 and a flicker suppressor 50. Power supply circuit 15 includes AC/DC converter 22, power converter 24, control circuit 38, pulse width modulator 40, pulse width modulator switch 28, and feedback circuit 29. Feedback circuit 29 includes current sensor 30, current amplifier 32, and peak current detector 34. The power supply 10 achieves flicker suppression at startup by limiting the current to the LED 26 during power-up so that the LED light output is below 110 percent of the LED light output corresponding to the dim command signal input to the pulse width modulator 40.

The power supply 10 uses current feedback circuit 29 to adjust the power to the LED 26, the pulse width modulator (PWM) 40 to provide dimming capability for the LED 26 and flicker suppressor 50 to prevent overshoot of the current to the LED 26 during startup of the power supply 10. Single-phase AC input is provided at block 20 and converted to DC by the AC/DC converter 22 to provide a DC voltage to the power converter 24. Power converter 24 regulates the power to LED 26 based on a current error generated at the control circuit 38. The flicker suppressor 50 provides a signal to the control circuit 38 to suppress current overshoot at the LED 26 when pulse width modulator 40 starts to pulse the pulse width modulator switch 28. In particular, the flicker suppressor 50 prevents flicker due to current overshoot when the output light level from the LED 26 is within 1% to 25% of the maximum output light level. Typically, the flicker due to current overshoot is noticeable when the output light level from the LED 26 is within 1% to 10% of the maximum output light level.

The current sensor 30 measures the current flow to the LED 26 and provides a sensed current signal to the current amplifier 32. The amplified sensed current signal from the current amplifier 32 is provided to the peak current detector 34. The output signal of the peak current detector 34 is input to the control circuit 38 to provide a feedback signal to the control circuit 38 along with the signal from flicker suppressor 50. A signal output of the control circuit 38 is input to a gate of a switch within the power converter 24.

The pulse width modulator 40 receives a dim command signal 41 operable to adjust the duty cycle of the pulse width modulator 40. Typically, the user of the LED 26 provides the dim command signal 41 to the pulse width modulator 40. In one embodiment, the dim command signal 41 is provided by an automated system, which is operable to adjust an output light level from the LED 26 as a function of time. The pulses output from the pulse width modulator 40 operate to switch the pulse width modulator switch 28, which is in series with the LED 26. The output of the power converter 24 is input to the LED 26 and current flows through the LEDs 26 when the pulse width modulator switch 28 is pulsed. In this manner, pulse width modulator 40 switches the current on and off through the LED 26.

The details concerning the operation of the pulse width modulator 40 are described in Application Serial No. PCT IB2003/0059 of Tripathi et al. entitled Power Supply for LEDS filed on Dec. 11, 2003. The application is incorporated by reference herein.

Those skilled in the art will appreciate that many configurations of and couplings among the components of power supply 10 are possible. For example, the components can be connected electrically, optically, acoustically, and/or magnetically. Therefore, many embodiments of power supply 10 are possible.

Figure 2:
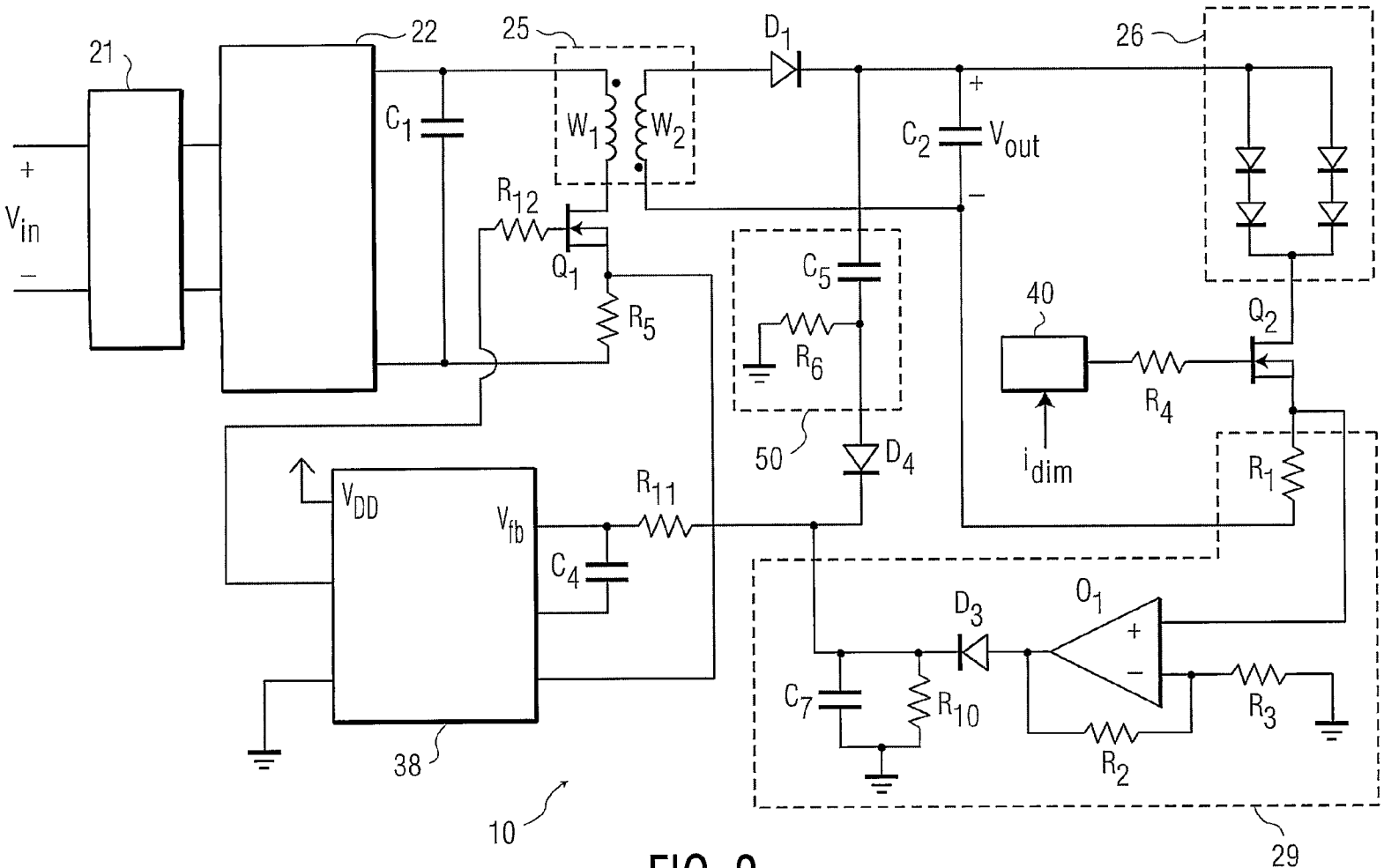
FIG. 2 shows a schematic diagram of a first embodiment of a power supply for an LED in accordance with the present invention.

FIG. 2 shows a schematic diagram of a first embodiment of a power supply 10 for an LED 26 in accordance with the present invention. The power supply 10 limits current to the LED 26 during power-up by limiting output voltage to the LED 26 during power-up. The power supply 10 pulses a switch Q1 prior to switching the current to the LED 26 on. The switch Q1 is responsive to a control signal from a control circuit 38 to control the output voltage to the LED 26. The power supply 10 monitors the output voltage at the flicker suppressor 50 to generate an output voltage feedback signal, provides the output voltage feedback signal to the control circuit 38 and adjusts the control signal in response to the output voltage feedback signal. Specifically, flicker suppressor 50 injects a feedback signal to control circuit 38 in response to an increase in output voltage. This injected feedback signal decreases the rate of change of output voltage and thereby prevents excessive voltage buildup. Subsequently, the decreasing rate of change of output voltage reduces the flicker suppressor 50 feedback signal.

Power supply 10 employs a flyback transformer 25 driven by control circuit 38 to supply power to LED 26. Power supply 10 includes an EMI filter 21, an AC/DC converter 22, a flyback transformer 25 including windings W1 and W2, a control circuit 38, a feedback circuit 29, pulse width modulator switch Q2, a pulse width modulator (PWM) 40, resistors R1-R6, R10-R12, capacitors C1-C2, C4, C5, C7, diodes D1, D3, D4, and switch Q1 and operational amplifier O1. Switches Q1 and Q2 are n-channel MOSFETs. In an alternative embodiment, other types of transistors, such as an insulated gate bipolar transistor (IGBT) or a bipolar transistor, are used in place of n-channel MOSFET switches Q1 and Q2 to adjust the current.

Input voltage is supplied to power supply 10 at $V_{in}$ to EMI filter 21. The voltage can be an AC input and is typically 50/60 Hertz at 120/230 Vrms. EMI filter 21 blocks electromagnetic interference on the input. AC/DC converter 22 converts the AC output of EMI filter 20 to DC and can be a bridge rectifier. The flyback transformer 25 includes a primary winding W1 and a secondary winding W2 operable to power the LED 26. The flyback transformer 25 is controlled by control circuit 38, which is a power factor corrector integrated circuit, such as model L6561 manufactured by ST Microelectronics, Inc. The flyback transformer 25 with power factor corrector configuration is widely used to provide isolated fixed voltage DC power sources with high line power factors. Additional windings are operable to provide the necessary control $V_{dd}$ and zero crossing detection signal, as is well known to those skilled in the art.

The control circuit 38 supplies a transformer control signal to adjust the current flow through winding W1 of flyback transformer 25 to match the LED 26 current demand. The transformer control signal is input to the flyback transformer 25 when control circuit 38 pulses the gate of switch Q1 through resistor R12. Typically, the gate of switch Q1 is pulsed at about 100 kHz. The pulsed signals from switch Q1 enable energy transfer through the transformer windings W1/W2 to charge capacitor C2 and to provide the voltage output ($V_{out}$) to the LED 26.

The LED 26 is in parallel across capacitor C2 and resistor R1. The LED 26 is in series with the pulse width modulator switch Q2. When the pulse width modulator 40 pulses the gate of pulse width modulator switch Q2, current flows through the pulse width modulator switch Q2 and the LED 26 for the duration of the pulse. The pulse width modulator 40 receives a dim command signal, shown as $i_{dim}$. The dim command signal adjusts the duty cycle of the pulses to set the LED light output. The dim command signal is input to the pulse width modulator 40 to set the duty cycle as described in the above mentioned Patent Application Serial No. PCT IB2003/0059.

When the dim command signal is a low light dim command signal, the duty cycle of pulse width modulator 40 is low. In this state, the LED 26 receives current for a low duty cycle. The pulses from the pulse width modulator 40 are low frequency, typically about 300 Hz.

The feedback circuit 29 senses the current through the LED 26. The feedback circuit 29 includes operational amplifier O1 and a sensing resistor R1 in series with LED 26. A sensed current signal generated across resistor R1 is provided to the non-inverting input of operational amplifier O1. Operational amplifier O1 is configured as a non-inverting amplifier with resistor R2 across the inverting input and the output. The inverting input of operational amplifier O1 is grounded through resistor R3.

The feedback circuit 29 also includes a peak detect circuit, which includes diode D3, capacitor C7 and resistor R10 at the output of the operational amplifier O1. The anode of diode D3 is at the output of operational amplifier O1. Resistor R10 and capacitor C7 are in parallel to each other at the cathode side of the diode D3. The current feedback circuit 29 provides a feedback signal to control circuit 38 through resistor R11. The feedback signal to control circuit 38 adjusts the transformer control signal to the flyback transformer 25 to match the LED 26 current demand.

Without a flicker suppressor circuit 50, the power supply circuit supplies an overshoot of current to the LED 26 during power-up. The overshoot is due to a lag in the generation of a feedback signal to the control circuit 38, which causes excessive voltage to build up across the LED 26. Furthermore, the lag is due to lagging pulses from pulse width modulator 40 and/or the time needed to charge capacitor C7.

Without the flicker suppressor circuit 50, the transformer control signal input to the switch Q1 adjusts the current flow through winding W1 of flyback transformer 25 to match the LED 26 current demand until the sensed current signal and a referenced current signal are equal at the control circuit 38. When the sensed current signal and the referenced current signal are equal, the feedback error signal goes to zero. The output voltage builds up across capacitor C2, which is parallel to the LED 26, as the sensed current signal and the referenced current signal are reaching equalization. As pulses to the gate of pulse width modulator switch Q2 pulse the LED 26, the current sense voltage across resistor R1 is not continuous. The capacitor C7 of the peak detect circuit does not charge to a steady state value until pulse width modulator switch Q2 is turned on and off for a few cycles, since the time period between each pulse of the gate to pulse width modulator switch Q2 is relatively long for low LED light output. The control circuit 38 keeps building voltage across output capacitor C2 as capacitor C7 charges to its steady state value.

This voltage buildup causes the current in the LED 26 to build up to a level that is higher than the LED 26 requires. Once the voltage across capacitor C7 reaches a peak value corresponding to the peak LED current, the control circuit 38 turns off switch Q1 causing an undershoot in the LED current. Due to this overshoot and subsequent undershoot of the current to LED 26, a flicker in the optical output from the LED 26 is observed each time the power supply 10 is turned on for low LED light output.

Addition of the flicker suppressor 50 to the power supply 10 prevents overshoot and the resultant flicker during power-up of the power supply 10. Prior to the LED 26 being turned on by the pulsing of pulse width modulator switch Q2, the control circuit 38 begins operation and pulses the gate of switch Q1 through resistor R12. The pulsed signals from switch Q1 start building output voltage across capacitor C2. The derivative of voltage with time (dV/dt) across capacitor C5 provides an output voltage feedback signal to control circuit 38.

Flicker suppressor 50 includes a capacitor C5 and a resistor R6 connected in series between the output voltage and ground. Suppressor circuit 50 generates a flicker suppression feedback signal, which is provided to the control circuit 38 through diode D4 and resistor R11. The output voltage feedback signal is acquired at the connection of the capacitor C5 and the resistor R6. The flicker suppression feedback signal received by control circuit 38 decreases output voltage buildup across capacitor C2. Thus, during power-up of the LED 26 with power supply 10, the output voltage buildup across capacitor C2 is reduced. The output voltage buildup across capacitor C2 is thereby maintained below the value of voltage buildup obtained during power-up in a power supply that does not include flicker suppressor 50. The power supply 10 achieves flicker suppression by limiting the current to the LED 26 during power-up so that the LED light output is below 110 percent of the LED light output corresponding to the dim command signal input to the pulse width modulator 40.

In one embodiment, a current controller operable to compare the sensed current with a reference current is included in the feedback system 29. In another embodiment, a current controller and an optocoupler are included in the feedback system 29. The optocoupler is operable to isolate the DC circuit supplying the LEDs 26 from the AC circuit power supply at the EMI filter 21, the two circuits being on opposite sides of the transformer windings W1/W2. The feedback signal from the current controller is operable to drive the optocoupler.

The LED 26 can be white or colored LEDs, depending on the application, such as ambient mood lighting or vehicular tail lights. The LEDs 26 can be a number of LEDs connected in series or parallel or a combination of series and parallel circuits as desired.

Figure 3:
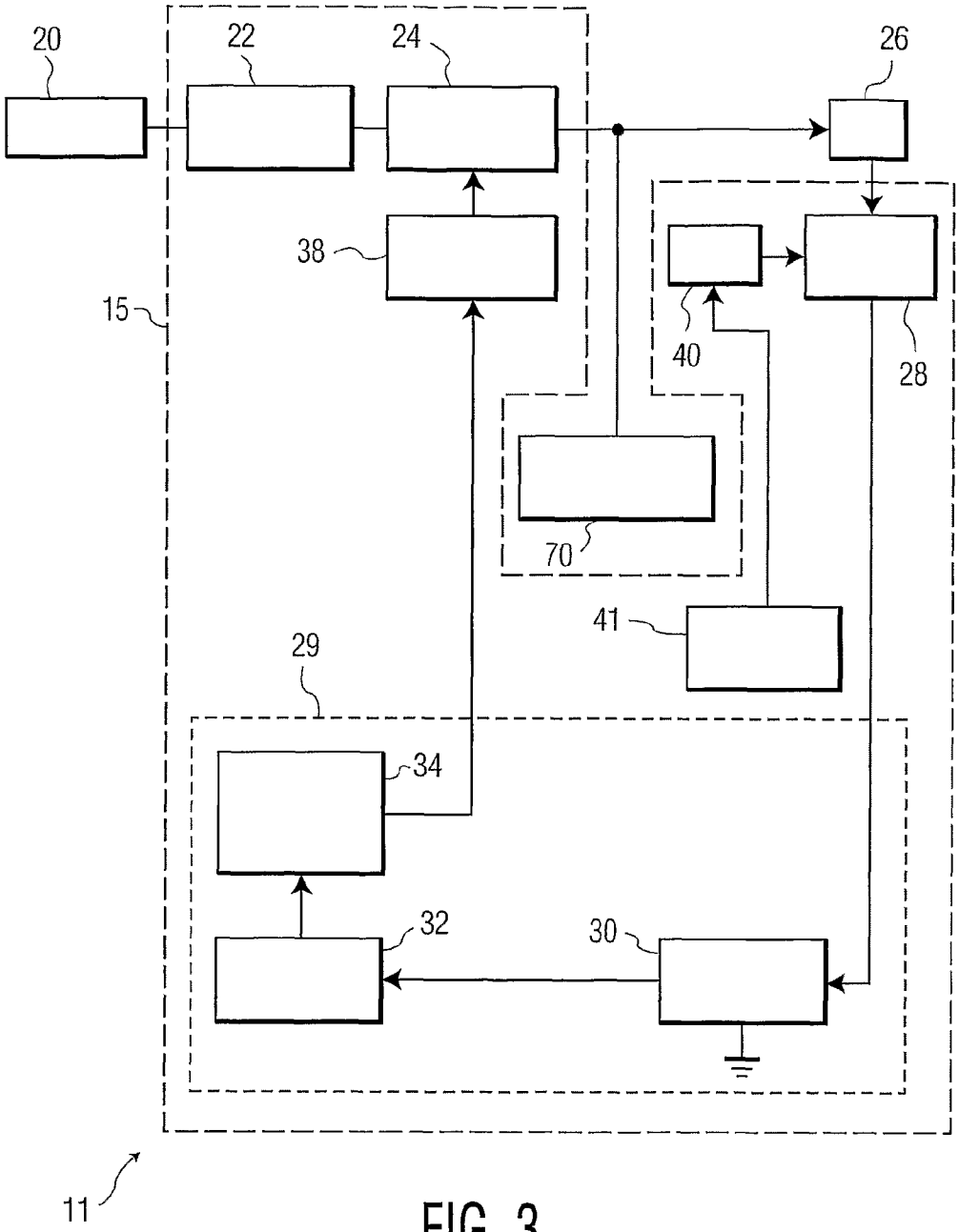
FIG. 3 shows a block diagram of a second embodiment of a power supply for an LED in accordance with the present invention.

FIG. 3 shows a block diagram of a second embodiment of a power supply 11 for an LED 26 in accordance with the present invention. The power supply 11 supplying LED 26 includes a power supply circuit 15 and a flicker suppressor 70. Power supply circuit 15 includes AC/DC converter 22, power converter 24, control circuit 38, pulse width modulator 40, pulse width modulator switch 28, and feedback circuit 29. Feedback circuit 29 includes current sensor 30, current amplifier 32, and peak current detector 34.

The power supply 11 achieves flicker suppression by limiting the current to the LED 26 during power-up so that the LED light output is below 110 percent of the LED light output corresponding to the dim command signal input to the pulse width modulator 40.

The flicker suppressor 70 clamps the output voltage to a maximum value in the event of excessive voltage buildup during start-up and speeds up the feedback signal generation to suppress flicker. In particular, the flicker suppressor 70 prevents flicker due to current overshoot when the output light level from the LED 26 is within 1% to 25% of the maximum output light level. Typically, the flicker due to current overshoot is noticeable when the output light level from the LED 26 is within 1% to 10% of the maximum output light level.

FIG. 3 differs from FIG. 1 in that the flicker suppressor 70 does not input a signal to the control circuit 38. The power supply 11 uses current feedback circuit 29 to adjust the power to the LED 26, the pulse width modulator (PWM) 40 to provide dimming capability for the LED 26 and flicker suppressor 70 to prevent overshoot of the current to the LED 26 during startup of the power supply 11. Single-phase AC input is provided at block 20 and converted to DC by the AC/DC converter 22 to provide a DC voltage to the power converter 24. Power converter 24 regulates the power to LED 26 based on the feedback signal representing a current error generated at the current controller 36. The feedback circuit 29 and pulse width modulator 40 operate as described in reference to FIG. 1.

The flicker suppressor 70 is turned on after the output voltage reaches a set level during the power-up of the LED 26. When flicker suppressor 70 turns on, the current flows through flicker suppressor 70 and not the LED 26. Once steady state is reached, flicker suppressor 70 is turned off and the current flows through the LED 26. Flicker suppressor 70 is on during the power-up phase in which the LED 26 is otherwise susceptible to a current overshoot.

Those skilled in the art will appreciate that many configurations of and couplings among the components of power supply 11 are possible. For example, the components can be connected electrically, optically, acoustically, and/or magnetically. Therefore, many embodiments of power supply 11 are possible.

Figure 4:
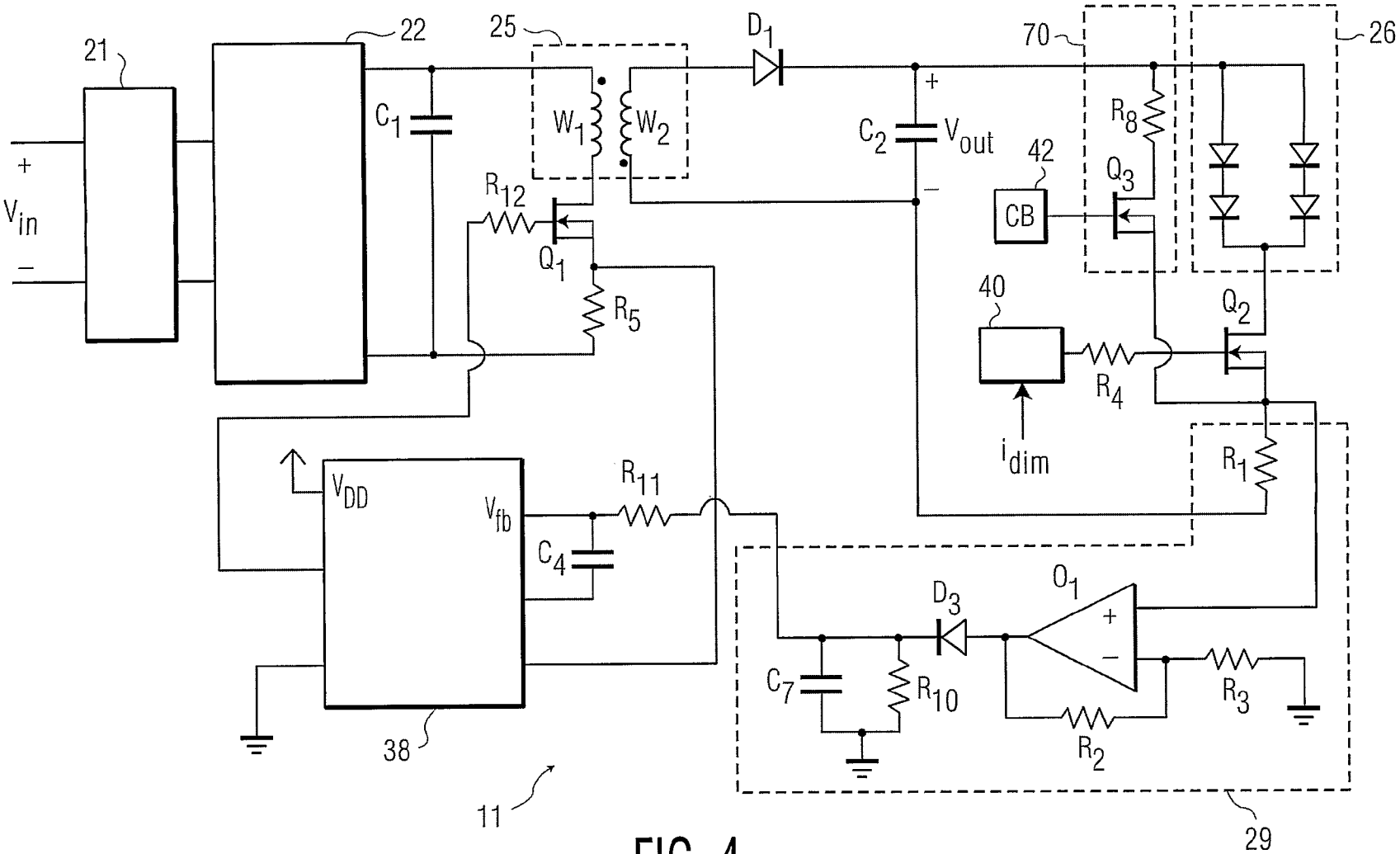
FIG. 4 shows a schematic diagram of a second embodiment of a power supply for an LED in accordance with the present invention.

FIG. 4 shows a schematic diagram of the second embodiment of a power supply 11 for an LED 26 in accordance with the present invention. Power supply 11 employs a flyback transformer 25 driven by control circuit 38 to supply power to LED 26. Power supply 11 includes an EMI filter 21, an AC/DC converter 22, a flyback transformer 25 including W1 and W2, a control circuit 38, a feedback circuit 29, pulse width modulator switch Q2, a pulse width modulator (PWM) 40, resistors R1-R5, R8, R10-R12, capacitors C1, C2, C4, C7, diodes D1, D3, switches Q1 and Q3, control block 42 and operational amplifier O1. Switches Q1, Q2 and Q3 are n-channel MOSFETs. In an alternative embodiment, other types of transistors, such as an insulated gate bipolar transistors (IGBT) or bipolar transistors, are used in place of n-channel MOSFETs Q1, Q2 and Q3 to adjust the current.

Voltage is supplied to power supply 11 as described for power supply 10 of FIG. 2. The feedback circuit 29 is configured and is operational as described for power supply 10 of FIG. 2. When the dim command signal is a low light dim command signal, the duty cycle of pulse width modulator 40 is low.

The power supply circuit supplies an overshoot current to the LED 26 without a flicker suppressor circuit 70. As described above, the overshoot is due to a lag in the generation of a feedback signal to the control circuit 38 as voltage across the LED 26 builds up to excessive levels. The transformer control signal input to the switch Q1 adjusts the current flow through winding W1 of flyback transformer 25 to match the LED 26 current demand until the sensed current signal and the referenced current signal are equal at the control circuit 38. When the sensed current signal and the referenced current signal are equal, the feedback error signal goes to zero. The output voltage builds up across capacitor C2, which is parallel to the LED 26, as the sensed current signal and the referenced current signal are reaching equalization. As pulses to the gate of pulse width modulator switch Q2 pulse the LED 26, the current sense voltage across resistor R1 is not continuous. When the dim command signal is set for a low light level, the capacitor C7 of the peak detect circuit does not charge to a steady state value until pulse width modulator switch Q2 has turned on and off for a few cycles. For low LED light output levels, the time between each of the pulses to the gate of pulse width modulator switch Q2 is relatively long. The control circuit 38 keeps building voltage across output capacitor C2 as capacitor C7 charges to its steady state value.

This voltage buildup causes the current in the LED 26 to build up to a level that is higher than the LED 26 requires. Once the voltage across capacitor C7 reaches a steady state value, the control circuit 38 turns off switch Q1 causing an undershoot in the LED current. Due to this overshoot and resulting undershoot of the current to LED 26, a flicker in the optical output from the LED 26 is observed each time the power supply 10 is turned on for low LED light output levels.

Addition of the flicker suppressor 70 to the power supply 11 prevents overshoot and the resultant flicker during power-up of the power supply 11. Switch Q3 is gated by a control block (CB) 42, which provides a continuous signal. Control block 42 is operable to turn on when the output voltage across capacitor C2 reaches a set level, which is below the level that would produce a current overshoot in the LED 26. When switch Q3 is turned on by the continuous signal from a control block 42, current flows through resistor R8 and switch Q3. Resistor R8 and switch Q3 form a series circuit in parallel across the LED 26. The value of resistor R8 is chosen to limit the current through switch Q3. This clamps the output voltage to the set level.

The feedback circuit 29 receives continuous feedback while switch Q3 is switched on so the capacitor C7 starts to charge. As capacitor C7 starts to charge, a feedback signal is injected into control circuit 38. The response rate of the control circuit 38 is increased, thereby preventing flicker when switch Q2 is gated. Once capacitor C7 is charged to its steady state value, switch Q3 is turned off allowing the current to flow through the LED 26. Thus, the power supply 11 achieves flicker suppression by limiting the current to the LED 26 during power-up so that the LED light output is below 110 percent of the LED light output corresponding to the dim command signal input to the pulse width modulator 40.

The control block 42 can be controlled by additional circuitry within the power supply 11 or circuitry external to the power supply 11, such as circuitry associated with the output voltage level.

In one embodiment, flicker suppressor 70 and flicker suppressor 50 are both included in the power supply 11 and each functions as described above.

Figure 5:
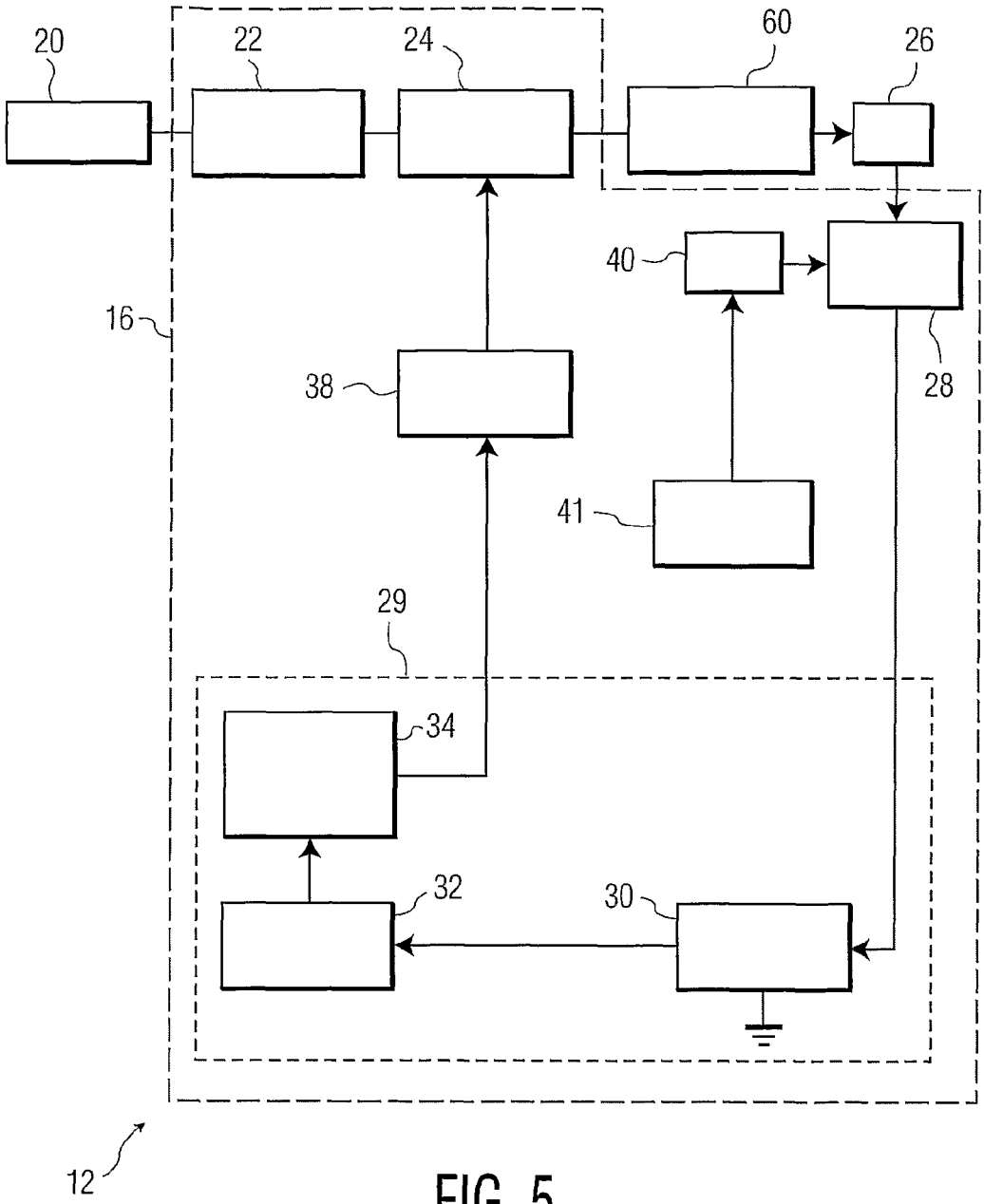
FIG. 5 shows a block diagram of a third embodiment of a power supply for an LED in accordance with the present invention.

FIG. 5 shows a block diagram of a third embodiment of a power supply 12 for an LED 26 in accordance with the present invention. The power supply 12 providing power to LED 26 includes a power supply circuit 16 and a flicker suppressor 60. Power supply circuit 16 includes AC/DC converter 22, power converter 24, control circuit 38, pulse width modulator 40, pulse width modulator switch 28, and feedback circuit 29. Feedback circuit 29 includes current sensor 30, current amplifier 32, and peak current detector 34. The power supply 12 achieves flicker suppression by limiting the current to the LED 26 during power-up so that the LED light output is below 110 percent of the LED light output corresponding to the dim command signal input to the pulse width modulator 40.

FIG. 5 differs from FIG. 1 in that the flicker suppressor 60 is in series with the LED 26. The power supply 12 uses current feedback circuit 29 to adjust the power to the LED 26, the pulse width modulator (PWM) 40 to provide dimming capability for the LED 26 and flicker suppressor 60 to prevent overshoot of the current to the LED 26 during startup of the power supply 12. Single-phase AC input is provided at block 20 and converted to DC by the AC/DC converter 22 to provide a DC voltage to the power converter 24. Power converter 24 regulates the power to LED 26 based on the feedback signal representing a current error generated at the current controller 38. The feedback circuit 29 and pulse width modulator 40 operate as described in reference to FIG. 1. The flicker suppressor 60 absorbs some of the output power during the power-up of the LED 26 and thus limits the voltage to the LED 26. This is accomplished by providing a temporary increased resistance in series with the LED 26 during the power-up and by removing the increased resistance during steady state.

The flicker suppressor 60 prevents flicker due to current overshoot when the output light level from the LED 26 is within 1% to 25% of the maximum output light level.

Typically, the flicker due to current overshoot is noticeable when the output light level from the LED 26 within 1% to 10% of the maximum output light level.

Those skilled in the art will appreciate that many configurations of and couplings among the components of power supply 12 are possible. For example, the components can be connected electrically, optically, acoustically, and/or magnetically. Therefore, many embodiments of power supply 12 are possible.

FIG. 6 shows a schematic diagram of the third embodiment of a power supply 12 for an LED 26 in accordance with the present invention. Power supply 12 employs a flyback transformer 25 driven by control circuit 38 to supply power to LED 26. Power supply 12 includes an EMI filter 21, an AC/DC converter 22, a flyback transformer 25 including W1 and W2, a control circuit 38, a feedback circuit 29, pulse width modulator switch Q2, a pulse width modulator (PWM) 40, resistors R1-R5, R7, R10-R12, capacitors C1, C2, C4, C7, diodes D1 and D3, switches Q1 and S7 and operational amplifier O1. In the example of FIG. 6, switches Q1 and Q2 are n-channel MOSFETs. Switch S7 may be an n-channel MOSFETs, which is open when power-up of the LED 26 begins and which is closed after power-up of the LED 26 is completed. In an alternative embodiment, other types of transistors, such as an insulated gate bipolar transistors (IGBT) or bipolar transistors, are used in place of n-channel MOSFETs Q1, Q2 and S7 to adjust the current.

The flicker suppressor 60 includes the resistor R7 and switch S7. Resistor R7 is in series with the LED 26 and is in parallel across switch S7. In operation, the flicker suppressor 60 increases the resistance in series with the LED 26 during power-up to limit the current to the LED 26 to maintain the LED light output to less than or equal to the LED light output which corresponds to the dim command signal. Voltage is supplied to power supply 12 as described for power supply 10 of FIG. 2. The feedback circuit 29 is configured and is operational as described for power supply 10 of FIG. 2.

The output pulses of pulse width modulator 40 have a duty cycle related to the dim command signal input to pulse width modulator 40 as described in the description of power supply 10 in FIG. 2. The output pulses of pulse width modulator 40 are provided to the gate of pulse width modulator switch Q2. During each pulse, current flows through the serially connected LED 26 and pulse width modulator switch Q2. When the dim command signal is a low light dim command signal, the duty cycle of pulse width modulator 40 is low.

During power-up of LED 26, the switch S7 in series with LED 26 is maintained in an open position and the gate of pulse width modulator switch Q2 is pulsed by the pulse width modulator 40. The current flows through resistor R7 since switch S7 is open. The voltage drop across resistor R7 reduces the voltage across the LED 26 to a level that prevents a current overshoot above the reference current. After power-up of the LED 26, the switch S7 is closed. The current then flows through the switch S7 with little or no resistance. This prevents the losses across resistor R7 during steady state operation. In one embodiment, the resistance of resistor R7 is about 10 ohms. The switch S7 can be controlled by additional circuitry within the power supply 12 or circuitry external to the power supply 12, such as circuitry associated with the dim command signal or an on command signal.

Without the voltage limitation provided by the flicker suppressor 60, the voltage across the LED 26, would reach levels that would cause the LED light output to exceed the LED light output corresponding to the dim command signal. Thus, the power supply 12 achieves flicker suppression by limiting the current to the LED 26 during power-up so that the LED light output is below 110 percent of the LED light output corresponding to the dim command signal input to the pulse width modulator 40.

The flicker suppressors as described above can be used in combination within a single power supply. In one embodiment, flicker suppressor 60 of FIG. 5 and flicker suppressor 50 of FIG. 1 are both included in the power supply and each functions as described above. In one embodiment, flicker suppressor 60 and flicker suppressor 70 of FIG. 3 are both included in the power supply and each functions as described above. In one embodiment, flicker suppressor 60, flicker suppressor 50 and flicker suppressor 70 are all included in the power supply and each function as described above.

FIG. 7 shows a block diagram of a fourth embodiment of a power supply 13 for an LED 26 in accordance with the present invention. While the power supplies 10, 11 and 12 of FIGS. 1-6 are current controlled voltage source output power converters, power supply 13 of FIG. 7 shows a current source output power converter for an exemplary DC-DC power converter. The power supply 13 supplying LED 26 includes a power supply circuit 17 and a flicker suppressor 80. Power supply circuit 17 includes DC/DC converter 23, control circuit 39, pulse width modulator 40, pulse width modulator switch 28, and feedback circuit 31. Feedback circuit 31 includes current sensor 30 and current amplifier 32.

The power supply 13 achieves flicker suppression by limiting the current to the LED 26 during power-up so that the LED light output is below 110 percent of the LED light output corresponding to the dim command signal input to the pulse width modulator 40.

In power supply 13, the DC input 21 is provided to DC/DC power converter 23. DC/DC power converter 23 regulates the power to LED 26 based on a feedback signal representing a current error generated by the control circuit 39.

The flicker suppressor 80 is operably connected in parallel with the pulse width modulator switch 28 and with the LED 26. The flicker suppressor 80 prevents overshoot of the current to the LED 26 during startup of the power supply 10 by providing an additional current path across the LED 26 during power-up when the voltage output is greater than a set limit. In particular, the flicker suppressor 80 prevents flicker due to current overshoot when the output light level from the LED 26 is within 1% to 25% of the maximum output light level. Typically, the flicker due to current overshoot is noticeable when the output light level from the LED 26 is within 1% to 10% of the maximum output light level.

The feedback signal is generated by feedback circuit 31 and directed to control circuit 39. The current sensor 30 measures the current flow to the LED 26 and provides a sensed current signal to the current amplifier 32. The amplified sensed current signal is input to the control circuit 39 as a feedback signal. The control circuit 39 generates a control signal, which is input to the DC/DC power converter 23.

The pulse width modulator (PWM) 40 provides dimming capability for the LED 26. The pulse width modulator 40 receives a dim command signal 41 operable to adjust the duty cycle of the pulse width modulator 40. The pulses output from the pulse width modulator 40 operate to switch the pulse width modulator switch 28, which is in parallel with the LED 26.

Those skilled in the art will appreciate that many configurations of and couplings among the components of power supply 13 are possible. For example, the components can be connected electrically, optically, acoustically, and/or magnetically.

It is important to note that FIGS. 1-7 illustrate specific applications and embodiments of the present invention, and is not intended to limit the scope of the present disclosure or claims to that, which is presented therein. Upon reading the specification and reviewing the drawings hereof, it will become immediately obvious to those skilled in the art that myriad other embodiments of the present invention are possible, and that such embodiments are contemplated and fall within the scope of the presently claimed invention.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

The invention claimed is:

1. A method of flicker suppression for an LED, comprising:

providing a power supply for supplying current to the LED, the power supply comprising a flicker suppressor and being responsive to a dim command signal;

receiving the dim command signal at the power supply, wherein the dim command signal is a low light dim command signal;

switching the current on; and limiting the current to maintain LED light output below 110 percent of the LED light output corresponding to the dim command signal, wherein limiting output voltage to the LED during power-up comprises: pulsing a switch prior to switching the current on, the switch being responsive to a control signal from a control circuit to control the output voltage; monitoring the output voltage at the flicker suppressor to generate an output voltage feedback signal; providing the output voltage feedback signal to the control circuit; and adjusting the control signal in response to the output voltage feedback signal.

2. The method of claim 1, wherein the limiting the current further comprises limiting the current during power-up.

3. The method of claim 1, wherein the limiting the current further comprises limiting the current to maintain LED light output between 105 and 95 percent of the LED light output corresponding to the dim command signal.

4. The method of claim 1, wherein the limiting the current further comprises limiting the current to maintain LED light output less than or equal to the LED light output corresponding to the dim command signal.

5. The method of claim 1, wherein receiving the dim command signal at the power supply comprises:

receiving the dim command signal at a pulse width modulator.

6. The method of claim 1, wherein switching the current on comprises:

pulsing a pulse width modulator switch responsive to the dim command signal.

7. The method of claim 1, wherein limiting the current comprises limiting output voltage to the LED during power-up.

8. The method of claim 7, wherein the flicker suppressor comprises:

a capacitor and a resistor connected in series between the output voltage and ground; wherein the output voltage feedback signal is acquired at the connection of the capacitor and the resistor.

9. The method of claim 1, wherein limiting the current comprises increasing resistance in series with the LED during power-up.

10. The method of claim 9, wherein increasing resistance in series with the LED during power-up comprises:

providing a resistor in series with the LED, wherein the resistor is in parallel across a switch;

maintaining the switch in an open position during the power-up of the LED; and closing the switch after the power-up of the LED.

11. The method of claim 1, wherein limiting the current comprises providing a parallel current path across the LED during power-up.

12. The method of claim 11, wherein providing a parallel current path across the LED during power-up comprises:

providing a switch and a resistor in series to form a series circuit, the series circuit being in parallel across the LED;

providing a zener diode between voltage to the LED and a gate of the switch; and conducting at least part of the current through the series circuit when the voltage to the LED exceeds a voltage limit of the zener diode.

13. The method of claim 11, wherein providing a parallel current path across the LED during power-up comprises:

providing a switch and a resistor series to form a series circuit, the series circuit being in parallel across the LED; and closing the switch to conduct at least part of the current through the series circuit when switching the current on.

14. A system of flicker suppression for an LED, comprising:

a power supply for supplying current to the LED, the power supply comprising a flicker suppressor, and the power supply being responsive to a dim command signal;

means for receiving the dim command signal at the power supply;

means for switching the current on; and means for limiting the current to maintain LED light output below 110 percent of the LED light output corresponding to the dim command signal, wherein the means for limiting the current comprises means for increasing resistance in series with the LED during power-up comprising:

a resistor connected in series with the LED, wherein the resistor is in parallel across a switch;

means for maintaining the switch in an open position during the power-up of the LED; and means for closing the switch after the power-up of the LED, wherein limiting output voltage to the LED during power-up comprises: pulsing a switch prior to switching the current on, the switch being responsive to a control signal from a control circuit to control the output voltage; monitoring the output voltage at the flicker suppressor to generate an output voltage feedback signal; providing the output voltage feedback signal to the control circuit; and adjusting the control signal in response to the output voltage feedback signal.

15. The system of claim 14, wherein the means for receiving the dim command signal at the power supply comprises:

means for receiving the dim command signal at a pulse width modulator.

16. The system of claim 14, wherein the means for switching the current on comprises:

means for pulsing a pulse width modulator switch responsive to the dim command signal.

17. The system of claim 14, wherein the means for limiting the current is selected from the group consisting of means for limiting output voltage to the LED during power-up, means for increasing resistance in series with the LED during power-up, and means for providing a parallel current path across the LED during power-up.

18. A power supply for an LED, comprising:

a power supply circuit having an output for supplying current to the LED, the power supply circuit being responsive to a dim command signal; and a flicker suppressor operably connected to the output, the flicker suppressor includes means for limiting output voltage to the LED during power-up comprising:

means for pulsing a switch prior to switching the current on, the switch being responsive to a control signal from a control circuit to control the output voltage;

means for monitoring the output voltage at the flicker suppressor to generate an output voltage feedback signal;

means for providing the output voltage feedback signal to the control circuit; and means for adjusting the control signal in response to the output voltage feedback signal.

19. The power supply of claim 18, wherein the flicker suppressor comprises:

a capacitor and a resistor connected in series between voltage to the LED and ground;

wherein a feedback signal is acquired at the connection of the capacitor and the resistor and the feedback signal controls the voltage to the LED.

20. The power supply of claim 18, wherein the flicker suppressor comprises:

a switch; and a resistor in parallel across the switch and in series with the LED;

wherein the switch is open during power-up of the LED.

21. The power supply of claim 18, wherein the flicker suppressor comprises:

a switch in parallel across the LED;

wherein the switch conducts when powering-up the output.

22. A method of flicker suppression for an LED, the method comprising:

providing a power supply for supplying current to the LED, the power supply comprising a flicker suppressor and being responsive to a dim command signal;

receiving the dim command signal at the power supply;

switching the current on; and limiting the current to maintain LED light output below 110 percent of the LED light output corresponding to the dim command signal at least by limiting output voltage to the LED during power-up, wherein such limiting output voltage comprises:

pulsing a switch prior to switching the current on, the switch being responsive to a control signal from a control circuit to control the output voltage;

monitoring the output voltage at the flicker suppressor to generate an output voltage feedback signal;

providing the output voltage feedback signal to the control circuit; and adjusting the control signal in response to the output voltage feedback signal.

* * * * *